US007066321B2

(12) United States Patent
Kawaguchi et al.

(10) Patent No.: US 7,066,321 B2
(45) Date of Patent: Jun. 27, 2006

(54) PAPER CONTAINER

(75) Inventors: Yuji Kawaguchi, Tokyo (JP); Michiaki Fujita, Tokyo (JP); Hidesato Kizaki, Tokyo (JP); Kozo Ohira, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/846,459

(22) Filed: May 2, 2001

(65) Prior Publication Data

US 2001/0052480 A1 Dec. 20, 2001

(30) Foreign Application Priority Data

May 2, 2000 (JP) ..... 2000-133870
May 26, 2000 (JP) ..... 2000-156871
May 26, 2000 (JP) ..... 2000-156872
May 30, 2000 (JP) ..... 2000-161019
Jun. 5, 2000 (JP) ..... 2000-168141

(51) Int. Cl.
*A47K 5/08* (2006.01)
*B65D 17/00* (2006.01)

(52) U.S. Cl. ..... 206/77.1; 206/524.1; 206/525; 206/499; 229/122.32; 229/224; 229/122

(58) Field of Classification Search ..... 206/499, 206/555, 1.5, 484, 494, 77.1, 774, 779, 524.1, 206/525, 449; 229/224, 5, 164, 122.32, 122, 229/125.08, 225; 53/411; 221/51, 100, 221/134, 305, 309
See application file for complete search history.

(56) References Cited

U.S. PATENT DOCUMENTS 2,564,099 A 8/1951 Dunning
2,872,097 A * 2/1959 Graybill ..... 206/268
3,934,791 A 1/1976 Dick et al.
3,963,173 A * 6/1976 Stone ..... 229/225
5,314,114 A * 5/1994 Stone ..... 229/225
5,320,279 A * 6/1994 Giblin et al. ..... 229/225
5,348,147 A * 9/1994 Gottfreid ..... 206/215
5,511,722 A * 4/1996 Dixon ..... 229/225
5,604,042 A 2/1997 Bianchini et al.

(Continued)

FOREIGN PATENT DOCUMENTS

FR 1 311 273 A 12/1962

(Continued)

*Primary Examiner*—Mickey Yu
*Assistant Examiner*—J. Gregory Pickett
(74) *Attorney, Agent, or Firm*—Birch,Stewart,Kolasch & Birch,LLP

(57) ABSTRACT

In a paper container 10 having a hexahedral configuration which is formed by shaping paper into a box, the paper container 10 comprises a container main body 12 and a lid member 14 hingedly attached to a back side edge part of an upper end open surface 13 of the container main body 12 and adapted to open/close the upper end open surface 13, a front board 15 of the container main body 12 being formed with a concave cutout part 16 extending from the upper end open surface 13. The lid member 14 comprises an upper surface lid part 17 for covering the upper end open surface 13, a front surface lid part 18 large enough to cover the concave cutout part 16, and a pair of side lid parts 19 interposed between side edge parts of the upper surface lid part 17 and side edge parts of the front surface lid part 18 and adapted to vertically join the front surface lid part 18 with the upper surface lid part 17. A tongue-like lock part 26 is disposed beneath the concave cutout part 16 and adapted to lock a lower end part of the front surface lid part 18 of the lid member 14.

9 Claims, 12 Drawing Sheets

U.S. PATENT DOCUMENTS 5,985,772 A * 11/1999 Wood et al. ..... 442/121
6,027,017 A * 2/2000 Kuhn et al. ..... 229/120.011

FOREIGN PATENT DOCUMENTS

| | | | |
|---|---|---|---|
| FR | 89 792 | E | 8/1967 |
| GB | 1 012 074 | A | 12/1965 |
| GB | 2 264 287 | A | 8/1993 |
| JP | 49-97226 | | 8/1974 |
| JP | 50-53322 | | 5/1975 |
| JP | 50-1383226 | | 11/1975 |
| JP | 51-60934 | | 5/1976 |
| JP | 53-63322 | | 5/1978 |
| JP | 54-30624 | | 2/1979 |
| JP | 55-145426 | U | 10/1980 |
| JP | 60-105324 | U | 7/1985 |
| JP | 62-188974 | U | 11/1986 |
| JP | 62-72921 | U | 5/1987 |
| JP | 62-125723 | U | 8/1987 |
| JP | 63-36389 | U | 3/1988 |
| JP | 63-55042 | A | 3/1988 |
| JP | 63-49318 | U | 4/1988 |
| JP | 1-58487 | U | 4/1989 |
| JP | 5-22320 | U | 3/1993 |
| JP | 6-37190 | U | 5/1994 |
| JP | 6-263141 | A | 9/1994 |
| JP | 3013083 | U | 4/1995 |
| JP | 7-28017 | U | 5/1995 |
| JP | 11-310221 | A | 11/1998 |
| JP | 3056312 | U | 11/1998 |
| JP | 111246 00 | | 11/1999 |
| WO | 96/01736 | A | 1/1996 |

* cited by examiner

PAPER CONTAINER

BACKGROUND OF THE INVENTION

1. Field of the Invention

The present invention relates to a paper container having a hexahedral configuration which is formed by shaping paper into a box.

2. Description of the Related Art

As a container for containing detergent, foodstuff and the like, a hexahedral paper container is widely used. This paper container comprises a container main body for containing a content and a lid member for covering an upper end open surface of the container main body. The content is taken out of the paper container by opening/closing the lid member. As the lid member, there are some which are known, such as a removable opening/closing lid which is provided separately from the container main body, a lid board which is open-and-closably hingedly attached to the back side edge parts of an upper end open surface and in which a lock piece formed by bending a tip part is engaged with an inner side of front side edge parts of the upper end open surface to thereby realize a sealing state, and the like.

In the case where the paper container is used as a container for storing detergent, foodstuff, etc., the paper container is formed by shaping an oil-resisting sheet of paper into a box because those stored in the container often contain oil. As a sheet of paper having an oil-resisting property, a laminated paper sheet formed by laminating an olefin-based or polyester-based film or by sticking an aluminum foil on that surface of a paper base material which serves as an inner surface of the paper container is used. When using such a conventional paper container in which a laminated paper sheet is used, entry of oil into the paper base material can effectively be blocked by the laminated film on the inner surface of the container.

Further, in the case where a paper container is used as a detergent container, the detergent is prevented from absorbing moisture by attaching a seal material to an entire periphery of an open edge part of the container main body in which detergent is stored.

Furthermore, there is, as disclosed in Japanese Patent Application Laid-Open No. 11-124600, a sheet-like detergent in which detergent is packaged with a water-soluble sheet. This detergent is compactly packaged, the quantity of use can easily be adjusted in actual use, handling is easy and it is no more required to take out the detergent by cutting the packing bag in use.

In the hexahedral paper container, an inner flap, an intermediate flap and an outer flap extending from respective sides surrounding an upper surface or bottom surface opening are sequentially folded one upon another and bonded together so that the opening is closed.

However, in the case of the conventional paper containers, that one having the opening/closing lid separately provided is inconvenient to handle, and another one having the lid board tends to produce a gap at the peripheral area, thus making it difficult to obtain a favorable sealing state. In the case where sheet-like matters, in particular, are stored as contents in the container in the form of layers, the stored matters are difficult to be taken out from the upper end open surface.

Moreover, the conventional paper containers give rise to such a problem that when a laminated paper is cut and its cut section formed in a peripheral edge part end face or the like contacts with the contents, oil tends to ooze out from the cut section and permeate into a paper base material. By this oil stain, the outer appearance of the paper container is badly degraded.

Since the conventional paper container has a rectangular parallelepiped configuration with a bottom and only its top surface is open, packaged detergent, which is vertically stacked up in layer, is difficult to be taken out. Especially, in the case of a packaged detergent in which the packaging material has a water-soluble property, the adjacent packaged detergent are readily stuck to each other when moisture is absorbed. This makes it even more difficult to take out the packaged detergent. Furthermore, when the container is to be opened, the seal material at the opening edge part of the paper container must be released over the entire circumference and therefore, this paper container is difficult to open.

In addition, in the case where sheet-like detergent is stored in the container in the form of layers, the water-soluble sheet is dissolved upon contact with a water-drop and the packaged detergent are readily stuck to each other.

At the time of closing the opening at the upper surface or bottom surface of the box container, an adhesive agent is applied to the outer surface of the inner flap and then, the intermediate flap is attached thereto. Thereafter, an adhesive agent is applied to the outer surface of the intermediate flap and then, the outer flap is attached thereto. Therefore, two steps are required for applying an adhesive agent and the facilities become complicated.

It is, therefore, an object of the present invention to provide a paper container which is easy to handle, and in which a favorable sealing state can be obtained at the time of closing and the content can more easily be taken out.

It is another object of the present invention to provide a paper container, in which even in the case where oil contained in the content of the container oozes out from a cut section of paper and permeates into a paper base material, the oil stain can be made less conspicuous so that the good outer appearance can easily be maintained.

A further object of the present invention is to provide a paper container, in which a packaged detergent is easy to take out and the detergent is prevented from absorbing moisture.

A still further object of the present invention is to provide a paper container, in which moisture-preventive property and water-drop entry-preventive property of the container are improved and sheet-like detergent packaged with a water-soluble sheet can be prevented from sticking to each other.

A yet further object of the present invention is to provide a paper container, in which at the time of manufacturing a paper container, the step for applying an adhesive agent is limited to only one so that the manufacturing process can be simplified and the facilities can also be simplified.

SUMMARY OF THE INVENTION

The present invention has achieved the above objects by providing a paper container having a hexahedral configuration which is formed by shaping paper into a box, the paper container comprising a container main body and a lid member hingedly attached to a back side edge part of an upper end open surface of the container main body and adapted to open/close the upper end open surface, a front board of the container main body being formed with a concave cutout part extending from the upper end open surface, and the lid member comprising an upper surface lid part for covering the upper end open surface, a front surface lid part large enough to cover the concave cutout part, and a pair of side lid parts interposed between side edge parts of the upper surface lid part and side edge parts of the front surface lid part and adapted to vertically join the front surface lid part with the upper surface lid part.

The phrase "upper end open surface" here means a surface of the container which is located at the upper end thereof and open.

Also, the present invention has achieved the above objects by providing a paper container, wherein an inner carton is mounted on an inner side of the container main body and the concave cutout part is formed in a front board of the inner carton, the container main body and lid member are formed by cutting and dividing the hexahedral paper box through a severance guide line extending from opposite ends of a connecting ridge line between an upper board and a back board of the paper box, and the severance guide line extends obliquely downward from the opposite ends of the connecting ridge line along a pair of side boards and extends along the front board beneath the concave cutout part formed in the front board of the inner carton.

Furthermore, the present invention has achieved the above objects by providing a paper container, wherein a lock part is disposed beneath the concave cutout part and adapted to lock a lower end part of the front surface lid part of the lid member.

In addition, the present invention has achieved the above objects by providing a paper container which is formed by shaping paper into a box and which stores an oil containing-content such as detergent and foodstuff, in which the paper is formed of a paper base material, a printed layer covering an outer surface of the paper base material, an outer colored film covering an outer surface of the printed layer, and an inner film covering an inner surface of the paper base material.

The above-mentioned colored film is a film obtained by applying various kinds of pigments such as an extender pigment and an inorganic pigment to a resin composing the film. The colored film may be obtained by printing color on the inner and outer surfaces of the film.

Also, the present invention has achieved the above objects by providing a paper container, which stores a packaged detergent, and wherein the container main body and the lid member are hingedly connected to each other, and the container main body is formed at a front board thereof with a concave cutout part. There are two types of packaged detergent. In the first type, the packaging material is formed of a water-soluble material and the packaged detergent can be thrown into a washing machine as it is, while in the second type, detergent is used by tearing up the package containing detergent and taking out the detergent from the package.

Besides, the present invention has achieved the above objects by providing a paper container, which stores a sheet-like detergent which is packaged with a water-soluble sheet and stacked up in layers, and wherein the paper container includes an inner carton which is inserted into the container main body along an inner surface thereof, an inner surface of the lid member in a closed position overlies the inner carton, and the container main body, the inner carton and lid member are formed of a moisture-proof material.

Furthermore, the present invention has achieved the above objects by providing a paper container in which an inner flap, an intermediate flap and an outer flap extending from each side surrounding a bottom surface of the container main body or an upper surface of the lid member are overlapped with one another in this order and bonded together, wherein the intermediate flap is provided at a part thereof with a cutout part. The expression "cutout part" herein used refers to a single or plural punched-out hole-like part, a part in which an end part of the rectangular flap is broken, or the like.

The paper container of the present invention offers the advantages that handling is easy, a favorable sealing state at the time of closing can be obtained and the content can more easily be taken out.

If, in the paper container of the present invention, the sheet of paper shaped into a box is formed of the paper base material, the printed layer covering an outer surface of the paper base material, an outer colored film covering an outer surface of the printed layer, and an inner film covering an inner surface of the paper base material, even in the case where oil contained in the content of the container oozes out from a cut section of paper and permeates into the paper base material, the oil stain can be made less conspicuous so that the good outer appearance can easily be maintained.

The paper container of the present invention also offers the advantages that, in the case where a packaged detergent is stored in the container, the packaged detergent is easy to take out and can be prevented from absorbing moisture.

In the paper container of the present invention, at the time of storing the sheet-like detergent packaged with a water-soluble sheet in layers, if there is a provision of an inner carton which is inserted along the inner surface of the container main body, the inner surface of the lid member in the closed position overlie s the inner carton and if the container main body, the inner carton and the lid member are formed of a moisture-preventive material, the moisture-preventive property and water-drop entry preventive property of the container can be improved and the sheet-like detergent packaged with a water-soluble sheet can be prevented from sticking to each other.

Furthermore, in the paper container of the present invention, at the time of overlapping the inner flap, the intermediate flap and the outer flap extending from each side surrounding the bottom surface of the container main body or the upper surface of the lid member in this order and bonding them, if the intermediate flap is provided at a part thereof with a cutout part, when a paper container is manufactured, the step for applying an adhesive agent is limited to only one so that the manufacturing process can be simplified and the facilities can also be simplified.

DETAILED DESCRIPTION OF THE INVENTION

Figure 1:
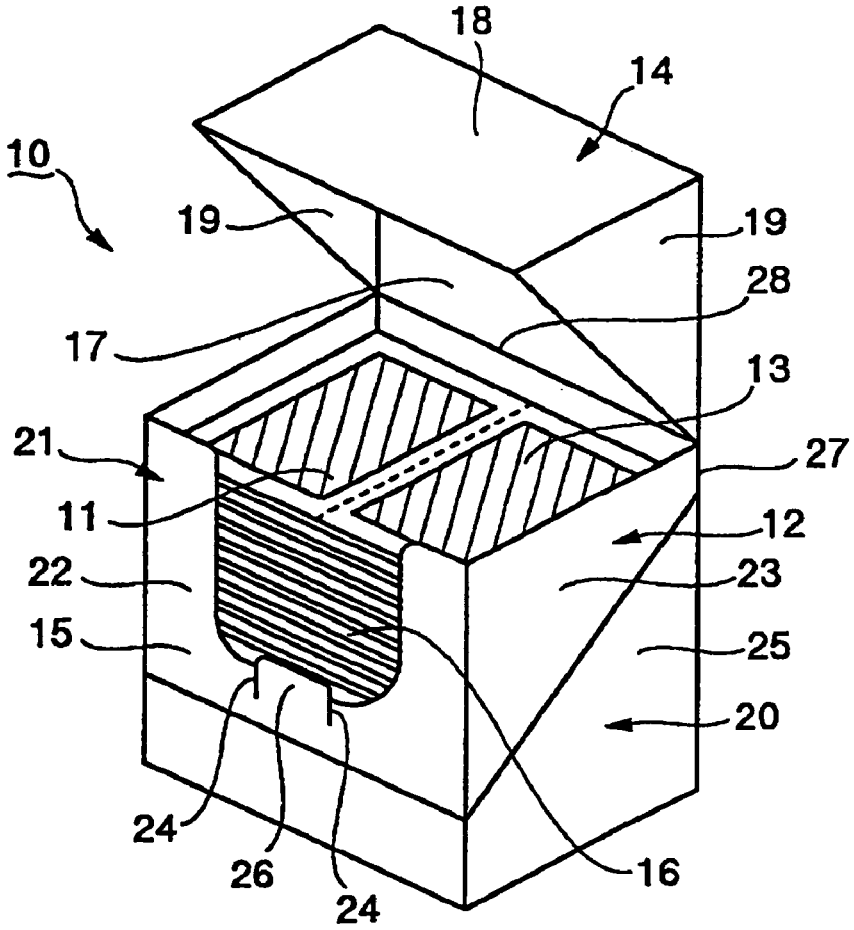
FIG. 1 is a perspective view of a paper container according to a first embodiment of the present invention, wherein a lid part is in an open position.

As shown in FIG. 1, a paper container 10 according to a first embodiment of the present invention is used, for example, as a container for containing a sheet-like detergent 11 of a thin plate-like form arranged in a multilayer. The sheet-like detergent 11 is formed into a sheet by sandwiching a washing detergent between water-soluble sheets. This sheet-like detergent 11 is thrown into a washing machine or the like as it is and used for washing.

The paper container 10 according to the first embodiment is a rectangular parallelepiped paper container which is formed by shaping a cardboard into a box. The paper container 10 comprises a container main body 12 and a lid member 14 hingedly attached to a back side edge part of an upper end open surface 13 of the container main body 12 and adapted to open/close the upper end open surface 13. A front board 15 of the container main body 12 is formed with a concave cutout part 16 extending from the upper end open surface 13. The lid member 14 comprises an upper lid part 17 adapted to cover the upper end open surface 13, a front lid part 18 large enough to cover the concave cutout part 16, and one pair of side lid parts 19 interposed between side edge parts of the upper lid part 17 and side edge parts of the front lid part 18 and adapted to vertically join the front lid part 18 with the upper lid part 17.

The cardboard constituting the paper container 10 is a laminated paper which comprises, for example, a paper base material, a printed layer and an outer film adapted to cover an outer surface of the paper base material, and an inner film adapted to cover an inner surface of the paper base material. This cardboard is cut into a predetermined development configuration and then folded into a three-dimensional configuration. Then, by bonding appropriate areas of the cardboard, a rectangular parallelepiped paper container 10 having, for example, a vertical length of 90 mm and a lateral length of 130 mm and a height of 100 mm.

Figure 2:
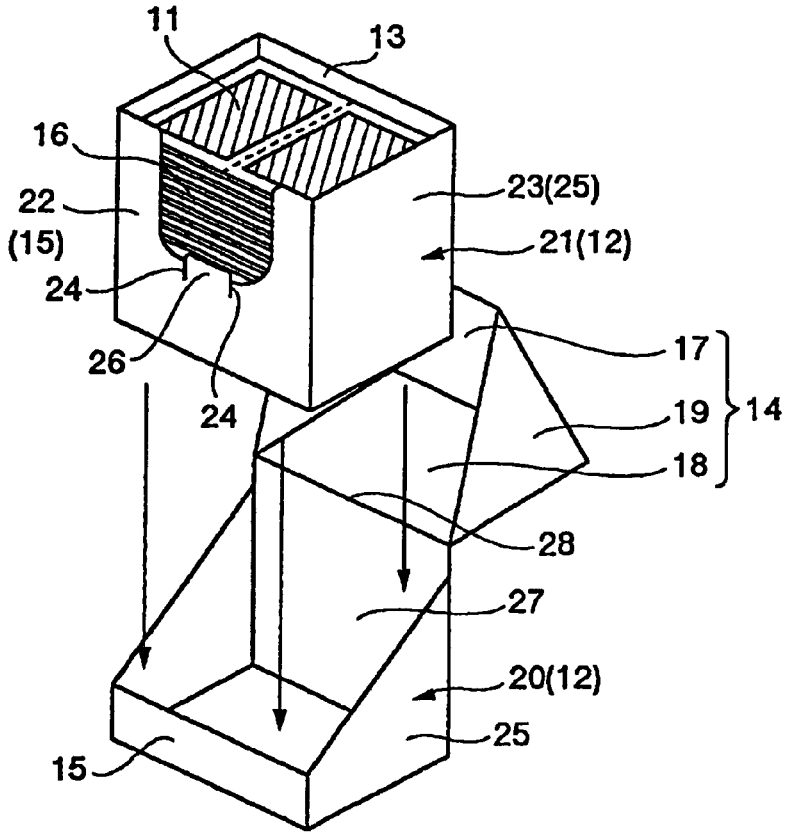
FIG. 2 is an exploded perspective view of the paper container according to the first embodiment of the present invention.

The container main body 12 is a rectangular parallelpiped box body whose upper end surface is opened as the upper end open surface 13. According to the first embodiment, the container main body 12 has, as shown in FIG. 2, a rectangular parallelepiped inner carton 21 mounted on an inner side of an outer jacket 20 which constitutes the container main body 12. Thus, the container main body 12 is of a dual construction. An upper half part of the front board 22 of the inner carton 21 and upper half parts of the pair of side boards 23 are exposed upward of the outer jacket 20, and therefore, form the front board 15 and the side boards 25, together with the outer jacket 20 (see FIG. 1).

According to the first embodiment, the exposed front board 22 of the inner carton 21 constituting the front board 15 of the container main body 12 is formed within its region of a lateral length of 100 mm and a height of 60 mm with the concave cutout part 16 extending from the upper end open surface 13 of the container main body 12 such that a lower end edge part of the concave cutout part 16 is curved. By cutting 24 opposite sides of a central part of the curved lower end edge part of the concave cutout part 16, a tongue-like lock part 26 is formed on the central part of the concave cutout part 16. A lower end part of the front lid part 18 of the lid member 14, which is described later, is engaged with this tongue-like lock part 26 when the lid member 14 of the container main body 10 is closed (see FIG. 3).

Figure 3:
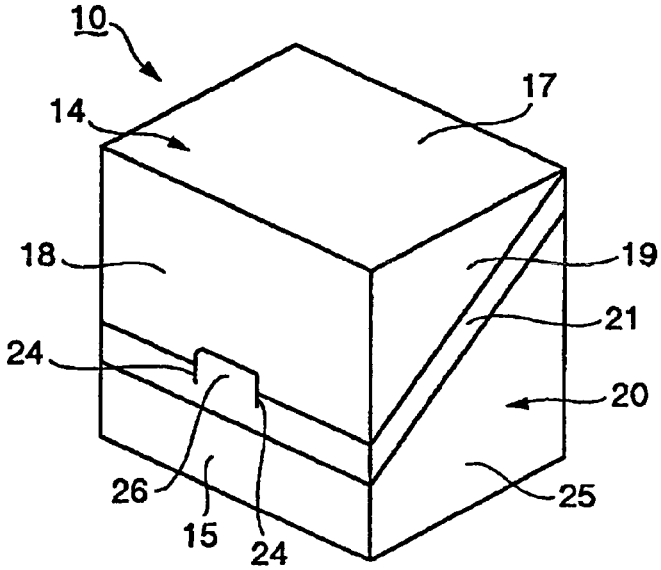
FIG. 3 is a perspective view of the paper container according to the first embodiment of the present invention, wherein the lid part is in a closed position.

The lid member 14 is hingedly attached at the back side edge part of the upper lid part 17 through a crease line 28 to the upper end edge part of the back board 27 of the outer jacket 20 which constitutes the container main body 12 (see FIG. 2). The lid member 14 is turned about this crease line 28 to open/close the upper end open surface 13. The upper lid part 17 has a square configuration having a londitudinal length of 90 mm and a lateral length of 130 mm, which is generally same as the size of the upper end open surface 13. The upper lid part 17 is arranged such that it overlies the upper end open surface 13 when the lid member 14 is in a closed position. The front lid part 18 has a square configuration having a lateral length of 130 mm and a height of 65 mm. An upper edge part of the front lid part 18 is vertically joined with a front side edge part of the upper lid part 17. Moreover, as shown in FIG. 3, when the lid member 14 is in a closed position, a lower end edge part of the front lid part 18 is located beneath the concave cutout part 16 of the container main body 12 and the lower end part is engaged with the tongue-like lock part 26 in such a manner that the lower end part is inserted into the cuts 24. In that state, the front lid part 18 covers the concave cutout part 16 from front. Each side lid part 19 has a right angled triangle configuration having a longitudinal length of 90 mm and a height of 65 mm. By joining the upper end edge part and front side edge parts, which are situated with the right angle sandwiched therebetween, with the side edge parts of the upper lid part 17 and the side edge parts of the front lid part 18, respectively, the side lid parts 19 retain a vertical joining relation of the front lid part 18 with the upper lid part 17.

Figure 4:
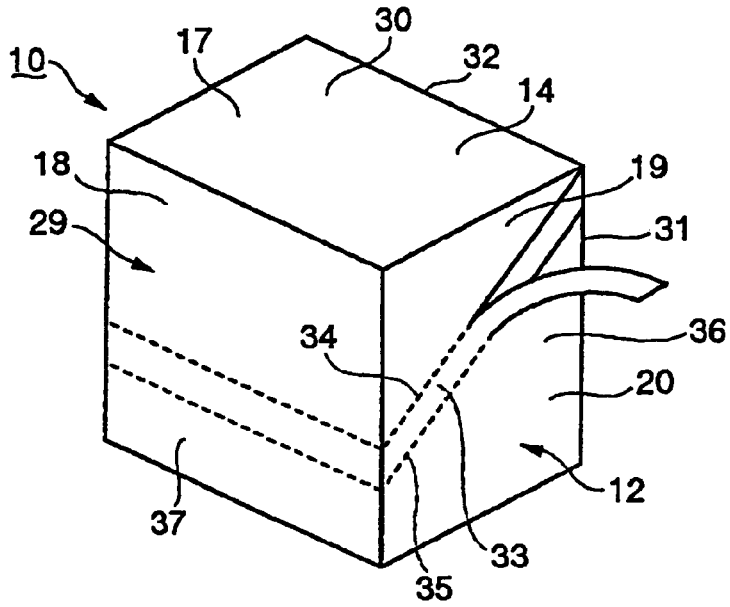
FIG. 4 is a perspective view for explaining a tearing up state of a cutting strip.

According to the first embodiment, the outer jacket 20 and the lid member 14, which constitute the container main body 12, are, as shown in FIG. 4, formed by cutting and dividing the hexahedral paper box 29 through a cutting belt 33 extending from opposite ends of a connecting ridge line 32 between the upper board 30 and the back board 31 of the paper box 29. The cutting belt 33 is formed by being sandwiched between one pair of upper and lower perforations 34, 35 as severance guide lines. By tearing up the cutting belt 33 along the perforations 34, 35, the paper box 29 is divided into the outer jacket 20 and the lid member 14 which are hingedly connected to each other by serving the connecting ridge line 32 as the crease line 28. The upwardly located perforations 34 extend obliquely downward from the opposite ends of the connecting ridge line 32 along the pair of side boards 36 of the paper box 29 and extend along the front board 37 of the paper box 29 beneath the concave cutout part 16 formed in the front board 22 of the inner carton 21. The lid member 14 formed by this comprises the upper lid part 17, the front lid part 18 and the pair of side lid parts 19 as previously mentioned.

According to the first embodiment, the paper container 10 is distributed and sold as a product in which the sheet-like detergent 11 stacked up in layers and the inner carton 21 are disposed within the paper box 29. At the time of use of the sheet-like detergent 11, the cutting belt 33 is torn up so that the paper box 29 is divided into the outer jacket 20 and the lid member 14 so that the lid member 14 is readily opened/closed. In that state, the lid member 14 is opened to take out the sheet-like detergent 11.

When using the paper container 10 of the first embodiment, since the lid member 14 is hingedly integrally connected to the container main body 12, handling is convenient when the lid member 14 is opened/closed. The lid member 14 has a sufficiently large three-dimensional configuration which comprises the upper lid part 17, the front lid part 18 and the side lid parts 19 and it can cover the upper end open surface 13 and the concave cutout part 16 of the container main body 12 without leaving any gap. Accordingly, the sheet-like detergent 11 can be received in the paper container 10 under a favorable sealing state while easily avoiding entry and attachment of foreign matter. Furthermore, since the concave cutout part 16 is formed in the front board 15, it becomes easy to pick up the sheet-like detergent 11 stacked up in layers from the front side and the sheet-like detergent 11 can easily be taken out. In addition, since the lid member 14 is hingedly attached to the container main body 12 at the connecting ridge line 32 of the paper box 29, the lid member 14 can be opened by being turned upward even in the case where the container main body 12 is installed with the back board 27 intimated contacted with the rear wall or the like. Thus, the sheet-like detergent 11 can easily be taken out through the upper end open surface 13 and the concave cutout part 16. Since the lid member 14 is hingedly attached at the connecting ridge line 32 to the container main body 12, the lid member 14 tends to float upward from the container main body 14 due to physical property of the cardboard readily to return to its original shape. This sometimes causes it difficult to retain a reliable sealing state. To avoid this unfavorable occurrence, the lower end part of the front lid part 18 of the lid member 14 is engaged with the tongue-like lock part 26 of the front board 15 of the container main body 12, so that a reliable sealing state can be retained. When the lid member 14 is closed, the lower end part of the front lid part 18 of the lid member 14 is engaged with the tongue-like lock part 26. Therefore, the sealing state can surely be retained, as well as the user can easily tell whether the paper container 10 is fully closed by feel.

That is to say, the paper container 10 of the first embodiment offers the advantages that easy handling and a reliable sealing state at the closed time of the lid member 14 can be obtained, and the sheet-like detergent 11 can more easily be taken out.

Figure 5:
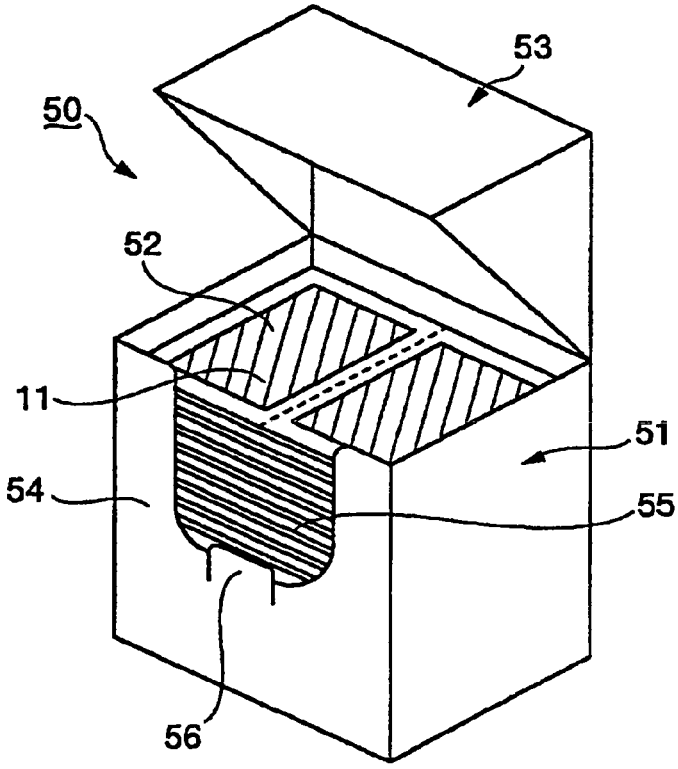
FIG. 5 is a perspective view of a paper container according to a second embodiment of the present invention, wherein a lid part is in an open position.

FIG. 5 shows a paper container 50 according to a second embodiment of the present invention. In this paper container 50, a container main body 51 is of a single structure in which no inner carton is employed. A lid member 53 is hingedly attached to a back side edge part of an upper open surface 51, the container main body 51 is formed at a front board 54 thereof with a concave cutout part 55, and a tongue-like lock part 56 is disposed at a lower end edge part of the front board 54. This paper container 50 is distributed and sold in a state that the upper end open surface 51 and the concave cutout part 55 are covered with the lid member 53 and a peripheral edge part of the lid member 53 is bonded to the container main body 51. The sheet-like detergent 11 is taken out by releasing the bonding state so that the lid member 53 is readily opened/closed. The same operation and effect as in the paper container 10 of the first embodiment can also be obtained by this paper container 50.

Figure 6:
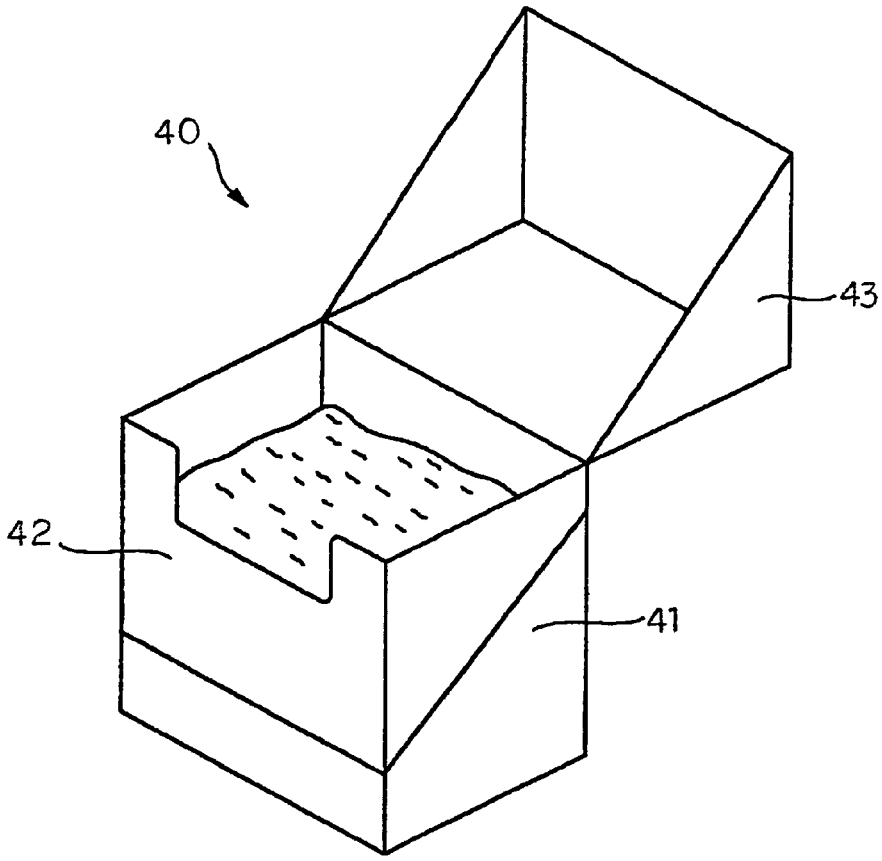
FIG. 6 is a perspective view of a paper container according to a third embodiment of the present invention, wherein a lid part is in an open position.

A paper container 40 according to a preferred third embodiment of the present invention is, for example, a rectangular parallelepiped box type container in which detergent in the form of powder is stored, as shown in FIG. 6. The paper container 40 can be shaped into a box by cutting a cardboard 41 having a constitution as is described later into a predetermined configuration and folding into a box-like configuration, and then bonding together the proper places through an adhesive agent. The paper container 40 comprises a container main body 42 and a lid member 43 hingedly connected to one side edge part of the upper opening of the container main body 42. The detergent in the form of powder is taken out of the container main body 42 by opening/closing the lid member 43.

The detergent in the form of powder is a nonionic detergent containing a nonionic surface active agent and it contains much oil content. Since the paper container 40 is formed by the cardboard 41 as later described, its inner surface is covered with an inner film 44, thereby effectively preventing the entry of the oil content contained in the powder detergent into the paper base material 45. On the other hand, at a cut section formed at the time for cutting the cardboard 41, the paper base material 45 is not covered with the inner film 44 and its end face is exposed. When this cut section contacts the powder detergent, the oil is oozed out and permeated into the paper base material 45, thus resulting in oil stain over a wide area of the paper base material 45. The third embodiment can effectively prevent deterioration of the outer appearance caused by such oil stain by forming the paper container 40 from the cardboard 41 which has a specific constitution as described hereinafter.

Figure 7:
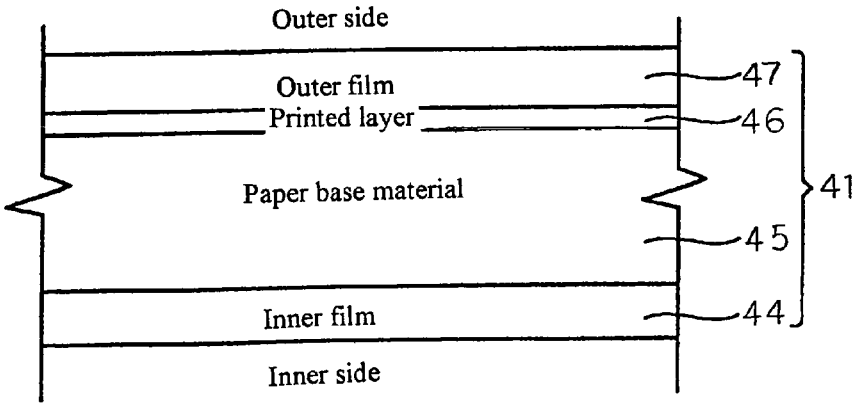
FIG. 7 is a sectional view for explaining a lamination structure of a cardboard.

That is to say, according to this embodiment, as shown in FIG. 7, the cardboard 41 is a laminated paper comprising the paper base material 45, a printed layer 46 covering an outer surface of the paper base material 45, an outer film 47 covering an outer surface of the printed layer 46, and an inner film 44 covering an inner surface of the paper base material 45.

The paper base material 45 is composed of a thin board-like paper having a thickness of 0.3 to 1.0 mm and a basis weight of 190 to 600 g/m$^2$ which is suited to cutting and folding processing.

The printed layer 46 is formed by making a solid printing of various kinds of figures, letters, etc. on the outer surface of the paper base material 45 over the entire area thereof by means of offset printing, gravure printing, or the like.

The outer film 47 is a colored film which is formed by adding various kinds pigments to olefin-based or polyester-based resin composing the film. The outer film 47 is colored into milk white color, yellow color, black color or the like, for example. The colored film may be obtained by printing color on the inner and outer surfaces of the film. This outer film 47 is 12 to 80 μm in thickness and preferably 20 μm in thickness. Since the colored film can make the oil stain caused by permeation of oil less conspicuous, the film is preferably colored into milk white. It may be applied with a plurality of colors. The outer film 47 is arranged in an intimately contacted manner on an outer surface of the paper base material 45 over the entire area thereof by being laminated in such a manner as to cover the printed layer 46.

The inner film 44 is a colored film like the outer film 47. The inner film 44 is formed by adding various kinds pigments to olefin-based or polyester-based resin composing the film. The inner film 44 is colored into, for example, milk white color, yellow color, black color or the like. The inner film 44 is not necessarily a colored film. It may be a transparent film. However, by making the inner film 44 as a colored film, stain caused by permeation of oil can be made less conspicuous. The inner film 44 is arranged in an intimately contacted manner on an inner surface of the paper base material 45 over the entire area thereof by being laminated in such a manner as to cover the paper base material 45.

When using the paper container 40 of this embodiment, even in the case where oil content oozes out through a cut section of the cardboard 41 and permeates into the paper base material 41 to cause an oil stain, the oil stain generated to the paper base material 45 can be made less conspicuous from outside because the outer surface of the paper base material 45 is covered with a combination of the printed layer 46 and the outer film 47 composed of a colored film. By this, the outer appearance of the paper container 40 can easily be maintained in a good condition.

The paper container 40 according to the third embodiment will be described hereinafter in more detail by way of Examples and a Comparative Example.

EXAMPLE 1 TO 4

Paper containers of Examples 1 to 4 having a generally same constitution as the paper container 40 of the third embodiment were formed using a cardboard whose outer colored film and inner colored film are as shown in Table 1. Then, a nonionic surface active agent, a nonionic active agent-contained power detergent, a donut and a fried potato were put into those paper containers. Thereafter, the outer appearance of each paper container was evaluated by an experimental method as later described. The result of evaluation is shown in Table 1.

COMPARATIVE EXAMPLE 1

A paper container of a comparative example 1 having a generally same constitution as the paper container 40 of the above-mentioned third embodiment was formed using a cardboard having a layer structure as shown in Table 1. It should be noted that the cardboard of the comparative example 1 is formed by applying a printed layer to an outer surface of the paper base material and a transparent film to its inner surface. A nonionic surface active agent, a nonionic active agent-contained power detergent, a donut and a fried potato were put into the paper containers of the comparative example 1. Thereafter, the outer appearance of each paper container was evaluated by an experimental method as later described. The result of evaluation is shown in Table 1.

It should be noted that each film shown in Table 1 is composed of an olefin-based resin and has a thickness of 20 μm.

TABLE 1

| | (outer side) ← layer structure → (inner side) | nonionic surface active agent | nonionic active agent-contained powder detergent | donut | fried potato |
|---|---|---|---|---|---|
| Comparative Example 1 | printed layer/paper base material/transparent film | X | X | X | X |
| Example 1 | milk white color film/printed layer/paper base material/transparent film | ○ | ○ | ○ | ○ |
| Example 2 | milk white color film/printed layer/paper base material/milk white color film | ◎ | ◎ | ◎ | ◎ |
| Example 3 | yellow color film/primed layer/paper base material/transparent film | ○ | ○ | ○ | ○ |
| Example 4 | black color film/printed layer/paper base material/transparent film | ○ | ○ | ○ | ○ |

[Evaluation of Outer Appearance of Paper Container]

The outer appearance of each paper container was evaluated in accordance with the following standard.

◎: Oil stain is not conspicuous not only from outside but also from inside of the container.

○: Oil stain is not conspicuous only from outside of the container but conspicuous from inside of the container.

X: Oil stain is conspicuous from outside of the container.

From the result of evaluation shown in Table 1, it is known that when an oil-contained matter is put into the paper container of the comparative example 1, its outer appearance is spoiled by occurrence of oil stain, but that even when the same oil-contained matter is put into the paper containers of the Examples 1 to 4, good outer appearances of those containers can be maintained.

Figure 8:
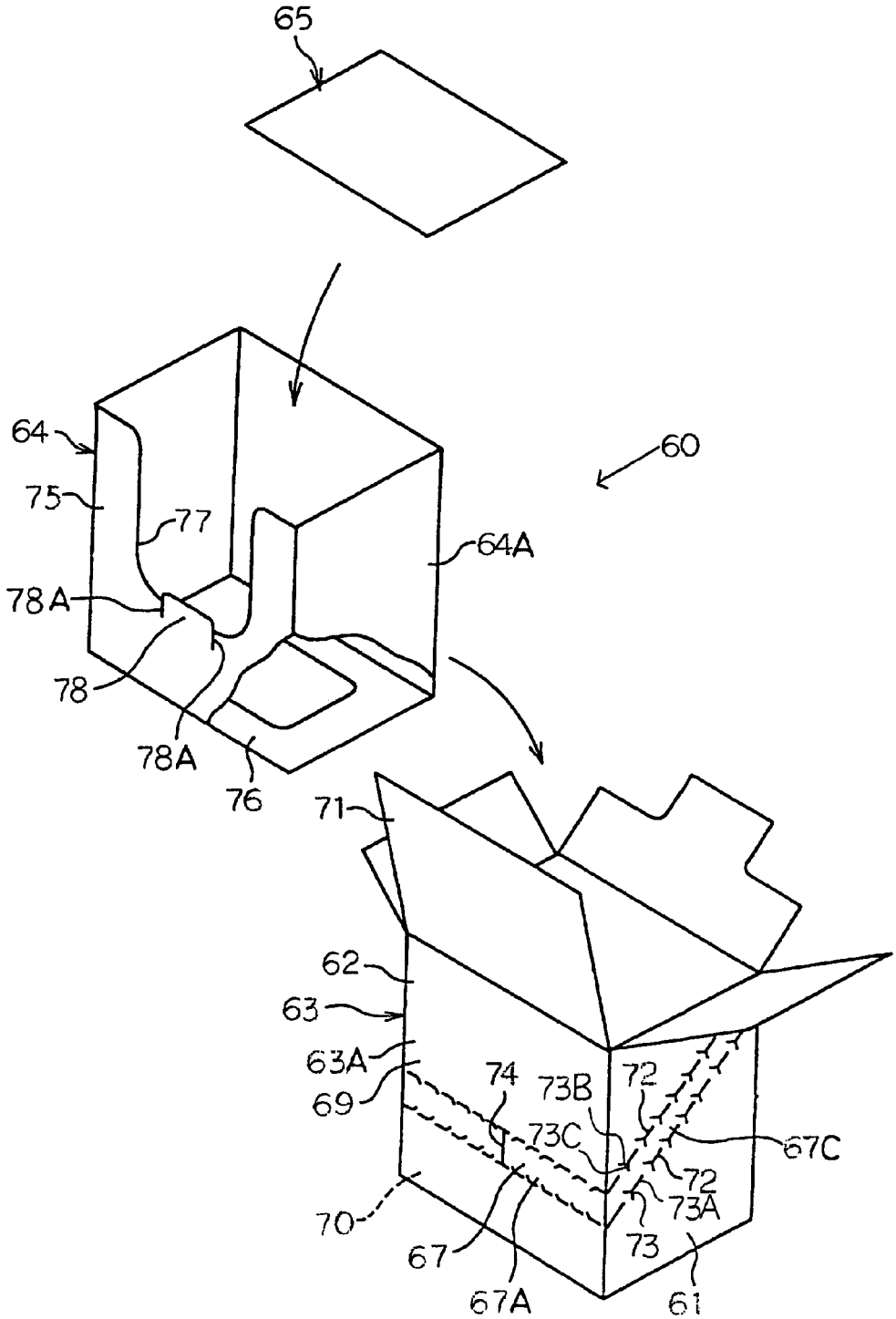
FIG. 8 is an exploded perspective view of a paper container according to a fourth embodiment of the present invention.
Figure 9:
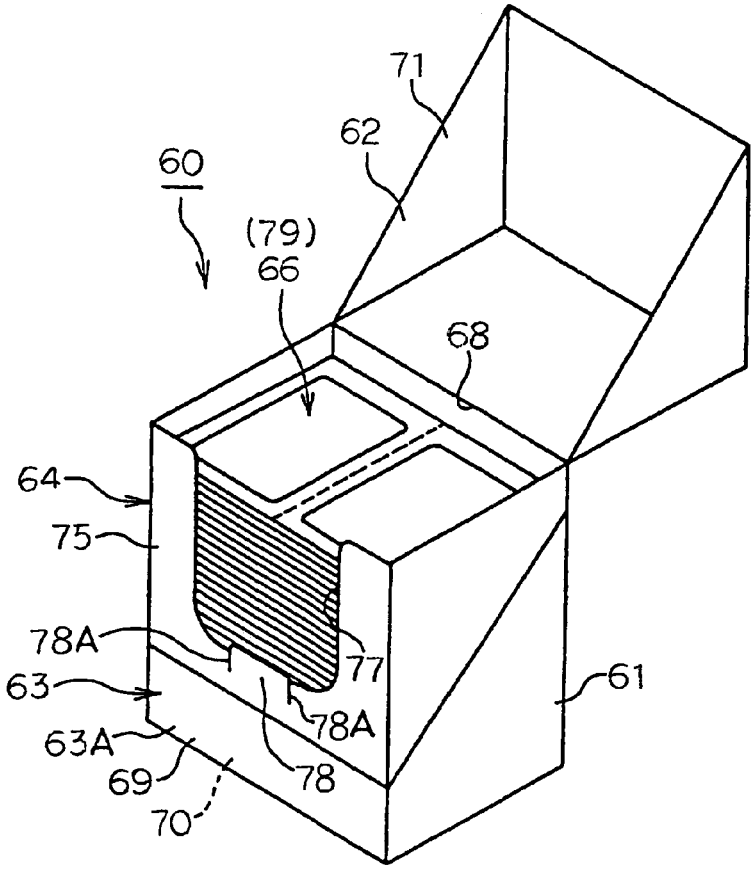
FIG. 9 is a perspective view of the paper container according to the fourth embodiment of the present invention, wherein a lid part is in an open position.

The paper container 60 according to a preferred fourth embodiment of the present invention, as shown in FIGS. 8 and 9, includes an outer box 63 comprising a container main body 61 and a lid member 62, an inner carton 64 inserted along an inner surface of the container main body 61, and a detergent ooze-preventive bottom board 65 (FIG. 5) which is laid on a bottom part of the container main body 61 and inner carton 64. The paper container 60 contains, for example, 30 sheets of plate-like detergent 66 stacked up in the form of layers.

The outer box 63 is composed of a raw material 63A which is obtained by sticking a moisture-absorptive cardboard, for example, polyethylene film and a cardboard (liner) to an inner surface side of a cardboard (coated board) in order. The outer box 63 has a rectangular parallelepiped lid member 62 with a ceiling connected to an open edge part of the rectangular parallelepiped container main body 61 with a bottom through an easy cut part 67. The lid member 62 is connected to the container main body 61 through a horizontal easy cut part 67A of a front lower part of the outer box 63 and oblique easy cut pats 67B, 67C of left and right side surfaces of the outer box 63 and hingedly connected thereto through a hinge connecting part 68 which is disposed at a ridge line between the back board of the container main body 61 of the outer box 63 and a ceiling board of the lid member 62.

In the outer box 63, the above-mentioned easy cut part 67 is provided at the front part and its left and right side parts of a body surface forming part 69 of the raw material 63A. The container main body 61 is formed by the body surface forming part 69 located below the easy cut part 67 and the hingedly connecting part 68, and the bottom forming part 70. The lid member 62 is formed by the body forming part 69 located above the easy cut part 67, and the ceiling forming part 71.

The easy cut part 67 is in the form of a strip which is sandwiched between upper and lower perforations 72, 72. The respective perforations of the oblique easy cut parts 67B, 67C are formed by intermittently arranging V-shaped cuts 73 penetrating all the way from a front surface to a rear surface of the raw material 63A. A long side 73A of the cut 73 is oriented in an extending direction of the easy cut part 67, one short side 73B out of two is oriented in a horizontal direction and the other short side 73C is oriented in a perpendicular direction. By this, the raw material 63A can be cut such that an end part of the long side 73A of one cut 73 out of adjacent two is connected to end parts of the short sides 73B, 73C of the other cuts 73 in both the horizontal and perpendicular directions. By doing so, the lid member 62 can be opened without generating any outer layer peel-off to the raw material 63A at the time of cutting. Owing to the feature in that the raw material 63A is made of paper, cutting of the easy cut part 67 can be made in a favorable manner. The easy cut part 67 is provided at a central area of the strip-like horizontal easy cut part 67A with a cut line extending between the upper and lower perforations 72, 72. This cut line serves as a cut start part 74.

It should be noted, however, that the easy cut part 67 is not necessarily in the form of a strip. Alternatively, it may be formed of a non-penetrating groove-like half cut line which is made in a thin design at one or both of the front and rear surfaces of the raw material 63A.

The inner carton 64 is composed of a moisture-proof cardboard, for example, a raw material 64A which is formed by sticking a polypropylene film to an inner surface of a cardboard (coated board). The inner carton 64 comprises a square sleeve-like wraparound body 75 and a hole-made bottom part 76 connected to a lower end of the body 75. The inner carton 64 is inserted along the inner surface of the container main body 61. An upper part of the wraparound body 75 is partly raised from the open end edge of the container main body 61, and the inner surface of the lid member 62 in the closed position is overlaid to provide a close fit. The inner carton 64 is provided at a front surface thereof with a concave cutout part 77. In the fourth embodiment, the inner carton 64 is abutted at its bottom part 76 with the bottom part of the container main body 61 and fixedly secured to the inner surface of the container main body 61 through an adhesive agent. However, the inner carton 64 is not necessarily provided with the bottom part 76. It may be provided with a non-perforated bottom part.

The inner carton 64 includes a lid insertion part 78 which can lock the edge of the lid member 62 when the lid member 62 is closed again after it is opened. In the fourth embodiment, a tongue piece sandwiched between two streaks of cutout line 78A, 78A formed in the edge which define the concave cutout part 77 at the front surface of the inner carton 64 serves as the lid insertion part 78.

The bottom board 65 is in the form of a flat board and composed of a moisture-proof cardboard, for example, a raw material which is formed by sticking a polypropylene film to an inner surface of a cardboard (coated board) as in the case with the inner carton 64.

Accordingly, the sequential procedure for manufacturing the paper container 60 is as follows. As shown in FIG. 8, before gluing of the ceiling formation part 71 of the raw material 63A which constitutes the outer box 63, this ceiling formation part 71 is opened and the inner carton 64 is inserted into the inside of the outer box 63 and bonded to the inner surface of the container main body 61. Then, the bottom board 65 is inserted into the inside of the inner carton 64 and bonded to the bottom surface of the inner carton 64. Subsequently, a plate-like detergent 66 is loaded to the inside of the outer box 63 and inner carton 64, and then, the ceiling formation part 71 of the outer box 63 is glued. It is also accepted that a sub-assembly in which the bottom board 65 and the plate-like detergent 66 are preliminarily stored within the faucet part 64 is inserted into the inside of the outer box 63.

The sequential procedure for using the paper container 60 is as follows. The easy cut part 67 of the outer box 63 is cut and the lid member 62 is opened relative to the container main body 61. An outer edge part of the plate-like detergent 66 facing the concave cutout part 77 of the inner carton 64 is handled to take out the plate-like detergent 66 from the outer box 63. The plate-like detergent 66 is packaged, for example, with a water-soluble film and therefore, it can be thrown into a washing machine as it is and without soiling the user's hand.

Hence, according to the fourth embodiment, the following function can be obtained.

(1) Especially, in the case where the material of the package for packaging the detergent is water-soluble, when the packaged detergents are stuck to each other due to moisture absorption, the packaged detergents can easily and surely be separated and taken out by inserting the user's hand from the concave cutout part 77 of the front board of the paper container 60.

(2) The inner carton 64 raised from the open edge of the container main body 61 is provided with the concave cutout parts 34, when the plate-like detergent 66 is stored in a storage part which is defined by the container main body 61 and inner carton 64. And the storage part is open not only at the ceiling side but also at the front board. Therefore, the outer edge parts of the plate-like detergents 66 vertically stacked up in the storage part in the form of layers are faced with the concave cutout part 77. This makes it possible for the user to pick up the outer edge part of the plate-like detergent 66 and take out the detergent 66 easily.

(3) When the paper container 60 is closed, the lid part 62 is engaged over the inner carton 64 raised from the open edge part of the container main body 61 so that entry of moisture into the paper container 60 is prevented. Thus, the plate-like detergent 66 can be prevented from absorbing moisture.

(4) The edge of the lid member 62 can be engaged with the lid insertion part 78 of the inner carton 64 at the time of closing the lid again. Accordingly, the lid member 62 can surely be closed again and the plate-like detergent 66 can be prevented from absorbing moisture.

(5) Merely by cutting the easy cut part 67 between the container main body 61 and the lid member 62 of the outer box 63, the opening procedure of the paper box 60 is completed. Therefore, opening procedure is easy.

(6) The easy cut part 67 of the outer box 63 is in the form of perforations, half-cut line, or the like, and therefore, moisture is easy to enter. However, entry of moisture is prevented by the inner carton 64 which is located at an inner side of the easy cut part 67. Thus, the plate-like detergent 66 is prevented from absorbing moisture.

(7) Since the hinge connecting part 68 of the outer box 63 is disposed at the ridge line between the back board of the outer box 63 and the ceiling board of the lid member 62, the lid member 62 can easily be opened without colliding against the wall even if no gap is formed between the back board of the outer box 63 and the wall of the container back side when the lid member 62 is opened.

Figure 10:
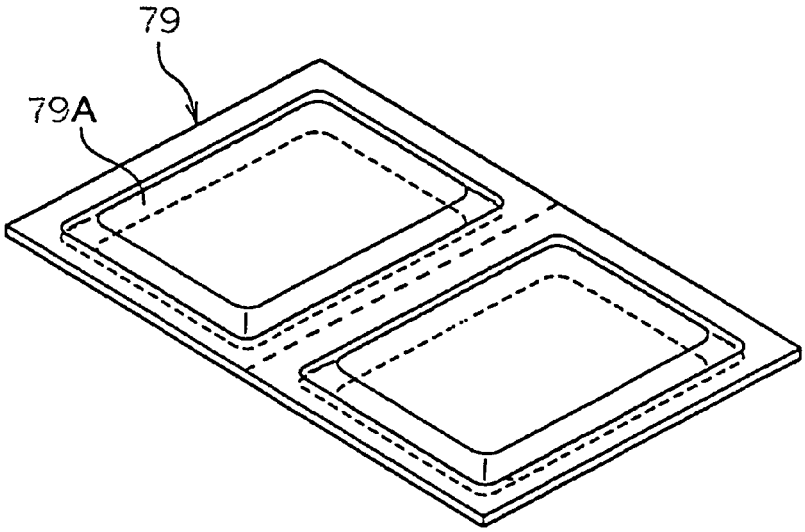
FIG. 10 is a perspective view showing a sheet-like detergent.

In the paper container 60 of the preferred fourth embodiment of the present invention, a plurality of sheet-like detergents 79 instead of the plate-like detergents 66, can be stored in the container 60 in the form of layers. The sheet-like detergent 79 herein used is of the type, for example, disclosed in Japanese Patent Application Laid-Open No. 11-124600. As shown in FIG. 10, the sheet-like detergent 79 is formed by packaging a detergent composition with a water-soluble sheet 79A. As the water-soluble sheet 79A, a water-soluble film, a nonwoven or woven fabric composed of water-soluble polymeric fibers, or a laminated sheet consisting of a water-soluble film and a nonwoven or woven fabric composed of a water-soluble polymeric fibers is preferred. As the detergent composition, there is, for example, an EO-PO-added nonionic surface active agent.

The sequential procedure for using the paper container 60 of the fourth embodiment in which the sheet-like detergent 79 is stored, is as follows. The easy cut part 67 of the outer box 63 is cut and the lid member 62 is opened relative to the container main body 61. An outer edge part of the sheet-like detergent 66 facing the concave cutout part 77 of the inner carton 64 is handled to take out the sheet-like detergent 79 from the outer box 63. The sheet-like detergent 79 is packaged, for example, with a water-soluble film and therefore, it can be thrown into a washing machine as it is and without soiling the user's hand.

Hence, according to the paper container 60 of the fourth embodiment in which the sheet-like detergent 79 is stored, the following function can be obtained.

(1) When the paper container 60 is closed, the lid member 62 is engaged over the inner carton 64 raised from the open edge part of the container main body 61 and the member container main body 61, the inner carton 64 and the lid member 62 are composed of a moisture proof material, so that entry of moisture and water drop into the box is prevented. Thus, the sheet-like detergents 79 can be prevented from sticking to each other by avoiding dissolving of the water-soluble sheet caused by moisture absorption and adhesion of water drop.

(2) Since the lid member 62 is hingedly connected to the container main body 61, the lid member 6 is immediately closed by its dead weight when the user's hand, which has opened the lid member 62, is touched off. By this, possibility of entry of water drop, which would otherwise occur when the lid member 62 is kept open, is reduced and therefore, the sheet-like detergents are prevented from sticking to each other.

(3) The easy cut part 67 is in the form of perforations, half-cut line, or the like, and therefore, moisture is easy to enter. However, entry of moisture is prevented by the inner carton 64 which is located at an inner side of the easy cut part 67. Thus, the sheet-like detergents 66 are prevented from sticking to each other.

(4) The inner carton 64 raised from the open edge part of the container main body 61 is provided with the concave cutout part 77, when the sheet-like detergent 79 is stored in a storage part which is defined by the container main body 61 and inner carton 64. And the storage part is open not only at the ceiling side but also sideways. Therefore, the outer edge parts of the sheet-like detergents 79 vertically stacked up in the storage part in the form of layers are faced with the concave cutout part 77. This makes it possible for the user to pick up the outer edge part of the sheet-like detergent 79 and take out the detergent 79 easily.

(5) The edge of the lid member 62 can be engaged with the lid insertion part 78 of the inner carton 64 at the time of closing the lid again. Accordingly, the lid member 62 can surely be closed again and the sheet-like detergents 79 can be prevented from sticking to each other.

Furthermore, in the paper container 60 of the preferred fourth embodiment of the present invention, the outer box 63 comprising the container main body 61 and the lid member 62 which are integrated through the easy cut part 67, includes, as shown in FIGS. 11 to 16, a body part 80 with 4 side boards 80A wrapped therearound, a bottom surface part 81 (bottom surface of the container main body 61) for closing a lower end opening of the body part 80, and a ceiling part 82 (upper surface of the lid member 62) for closing the upper opening of the body part 80.

The ceiling part 82 is constituted by overlapping and bonding together two inner flaps 83, an intermediate flap 84 and an outer flap 85 extending from the upper side of each side board 80A surrounding the upper opening of the body part 80 in this order.

In the fourth embodiment, the intermediate flap 84 is provided at opposite side parts thereof with a cutout part 84A and at the inside of the intermediate flap 84 with a plurality of punched-out hole-like cutout parts 84B. That area of the outer surface of the inner flap 83 which corresponds to the cutout part 84A of the intermediate flap 84 is subjected to emboss treatment, so that a protrusion 83 A is formed thereon.

The steps for manufacturing the ceiling part 82 of the outer box 63 is as follows, as shown in FIGS. 11, 12, 13(A) and 13(B).

Figure 11:
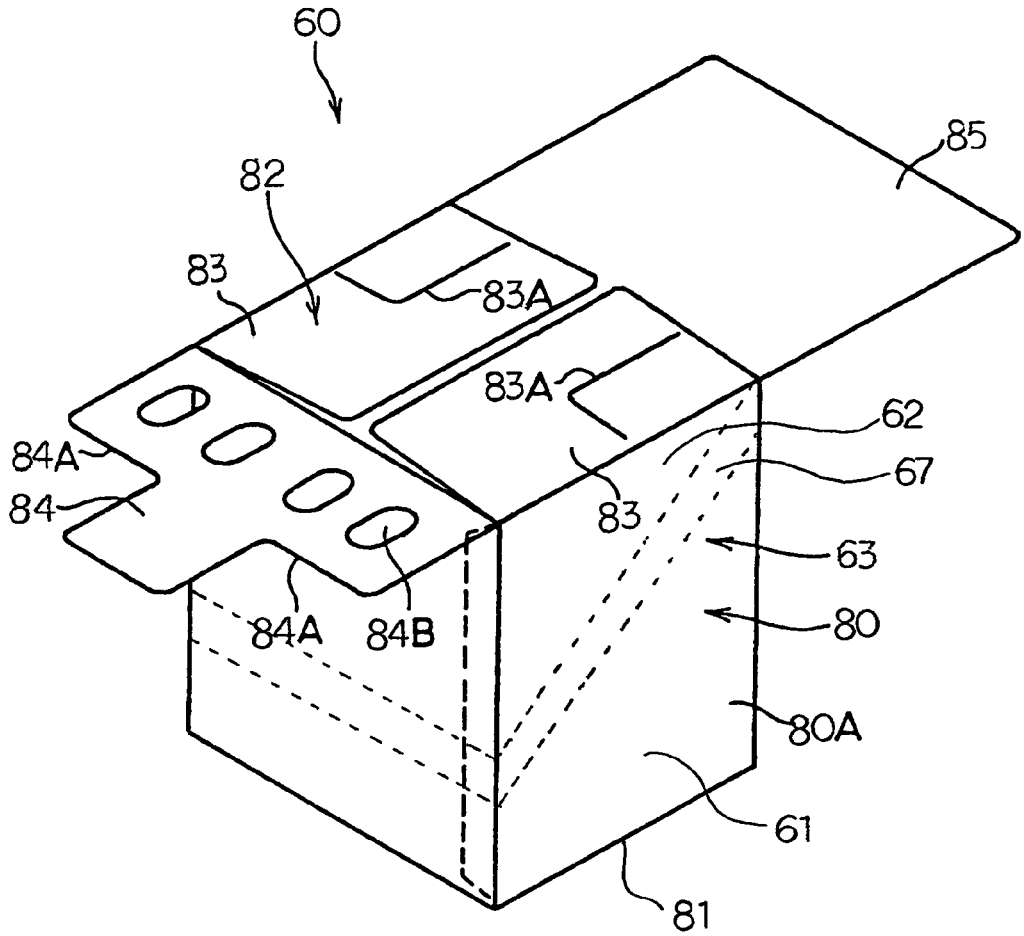
FIG. 11 is a perspective view showing an upper surface of a paper container before a bonding procedure is carried out.
Figure 12:
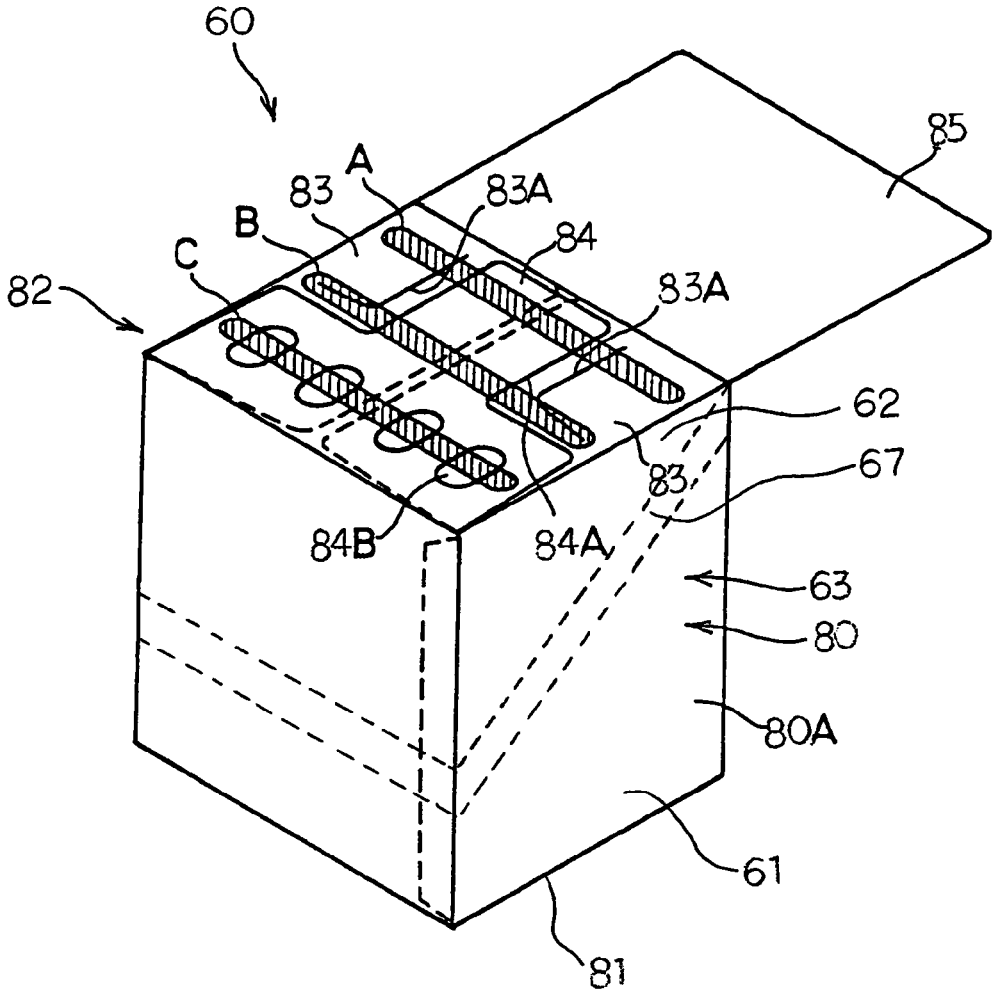
FIG. 12 is a perspective view showing the upper surface of the paper container, wherein a bonding procedure is in a midway.
Figure 13A:
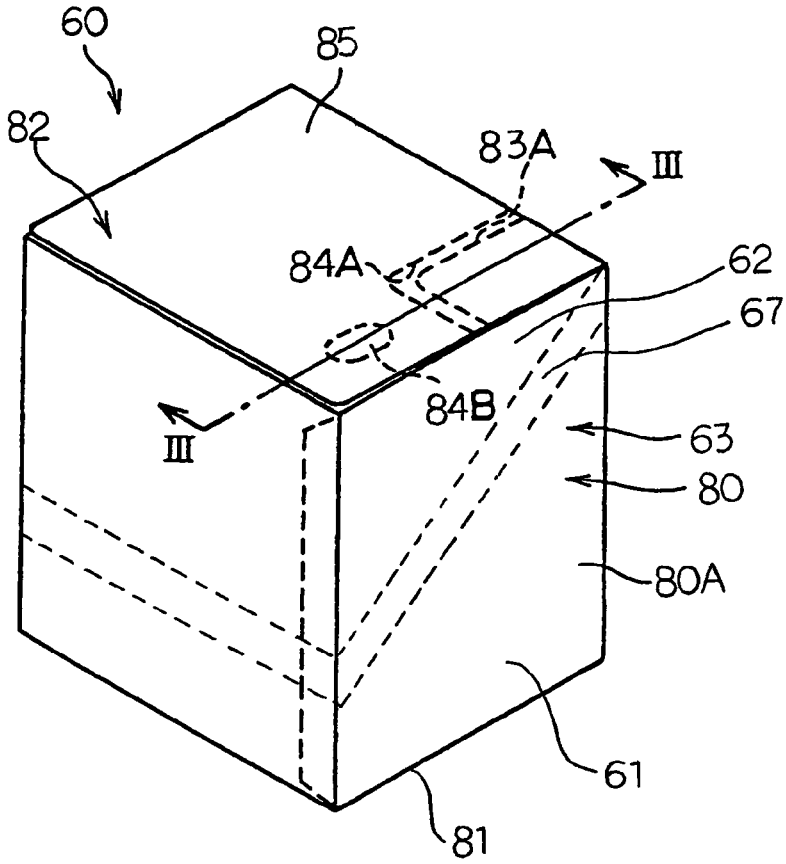
FIG. 13(A) is a perspective view showing the upper surface of the paper container, wherein a bonding procedure is completed.
Figure 13B:
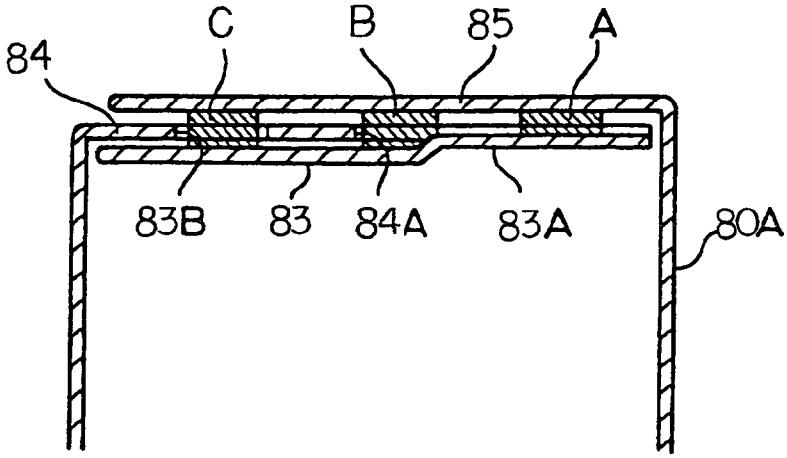
FIG. 13(B) is a sectional view taken on line III—III of FIG. 13(A).

(1) The intermediate flap 84 is folded on the outer surface of the inner flap 83, and, for example, three streaks of adhesive agent A, B, C are applied to their outer surfaces. The adhesive agents A, B are applied to the outer surface of the intermediate flap 84 and the outer surface of the inner flap 83 at a lower side of the cutout part 84A of the intermediate flap 84, while the adhesive agent C is applied to the outer surface of the intermediate flap 84 and the outer surface of the inner flap 83 at a lower side of the cutout part 84B of the intermediate flap 84 (FIGS. 11, 12).

(2) The outer flap 85 is folded on the inner flap 83 and the intermediate flap 84 of the above item (1). The outer flap 85 is bonded to the intermediate flap 84 through adhesive agents A, B, C. The outer flap 85 is also bonded to the inner flap 83 through the adhesive agents A, B, C supplied to the cutout parts 84A, 84B of the intermediate flap 84 (FIGS. 3(A) and 3(B)).

By this, the following function can be obtained.

(1) After the intermediate flap 84 is folded on the outer surface of the inner flap 83, adhesive agents A, B, C are applied to those outer surfaces and then, the outer flap 85 is folded thereon. By doing so, the outer flap 85 is bonded not only to the intermediate flap 84 through the adhesive agents A, B, C but also to the inner flap 83 through the adhesive agents A, B, C supplied to the cutout parts 84A, 84B of the intermediate flap 83. Accordingly, the inner flap 83, the intermediate flap 84 and the outer flap 85 can simultaneously be bonded together by a single adhesive agent applying process. Thus, the manufacturing process can be simplified and facilities can be simplified, too.

(2) That area of the outer surface of the inner flap 83 which corresponds to the cutout part 84A of the intermediate flap 84 is subjected to emboss treatment to thereby form a protrusion 83A. Accordingly, the outer surface of the intermediate flap 84 and the protrusion 83A of the inner flap 83 to which the outer flap 85 is to be bonded are made equal in height level, so that the outer flap 85 can be bonded to the inner flap 83 without leaving any gap therebetween. By doing so, the bonding strength of the above item (1) can be uniformed.

The bottom surface part 81 of the outer box 63 into which the inner carton 64 is inserted is constituted by folding the two inner flaps 86, one intermediate flap 87 and one outer flap 88 extending from a lower side of each side board 80A surrounding the lower opening of the body part 80 in this order and bonding them together.

In the fourth embodiment, the intermediate flap 87 is provided at opposite side parts thereof with a cutout part 87A and the intermediate flap 87 is also provided at its inside with a plurality of punched-out hole-like cutout parts 87B.

In the fourth embodiment, the inner carton 64 inserted into the outer flap 63 is bonded to the inner surface of the inner flap 86. That area of the inner flap 86 which corresponds to the cutout part 87A of the intermediate flap 87 is also provided with the punched-out hole-like cutout part 86A.

The sequential procedure for manufacturing the bottom surface part 81 of the outer box 63 is as follows, as shown in FIGS. 14, 15, 16(A) and 16(B).

Figure 14:
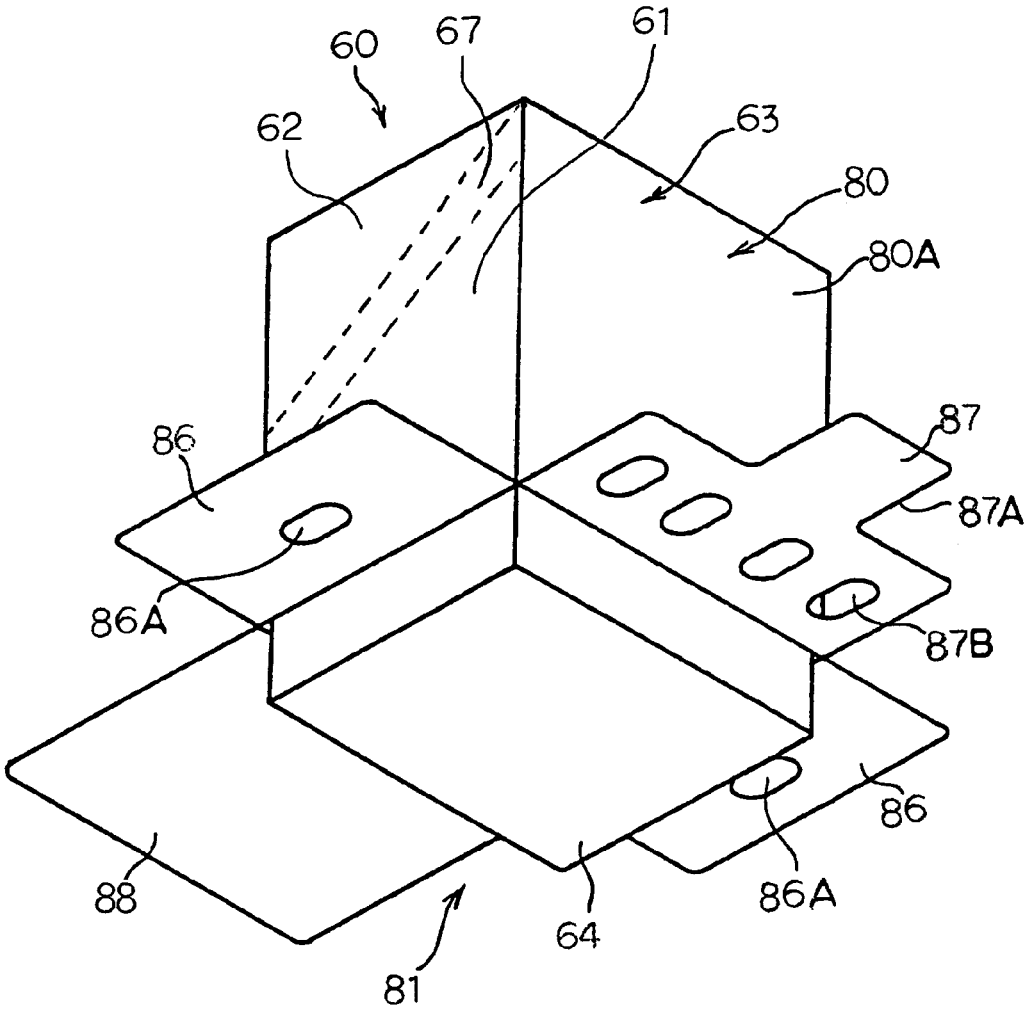
FIG. 14 is a perspective view showing a bottom surface of the paper container before a bonding procedure is carried out.
Figure 15:
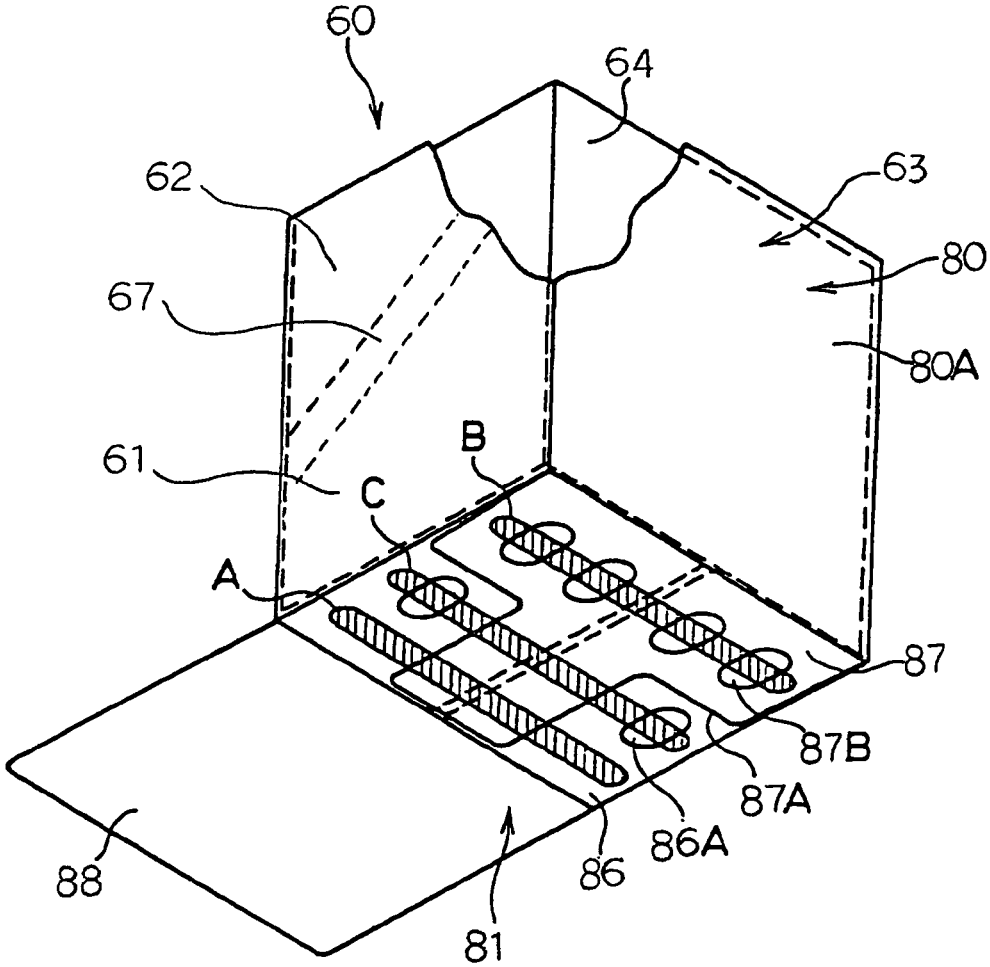
FIG. 15 is a perspective view showing the bottom surface of the paper container, wherein a bonding procedure is in a midway.
Figure 16A:
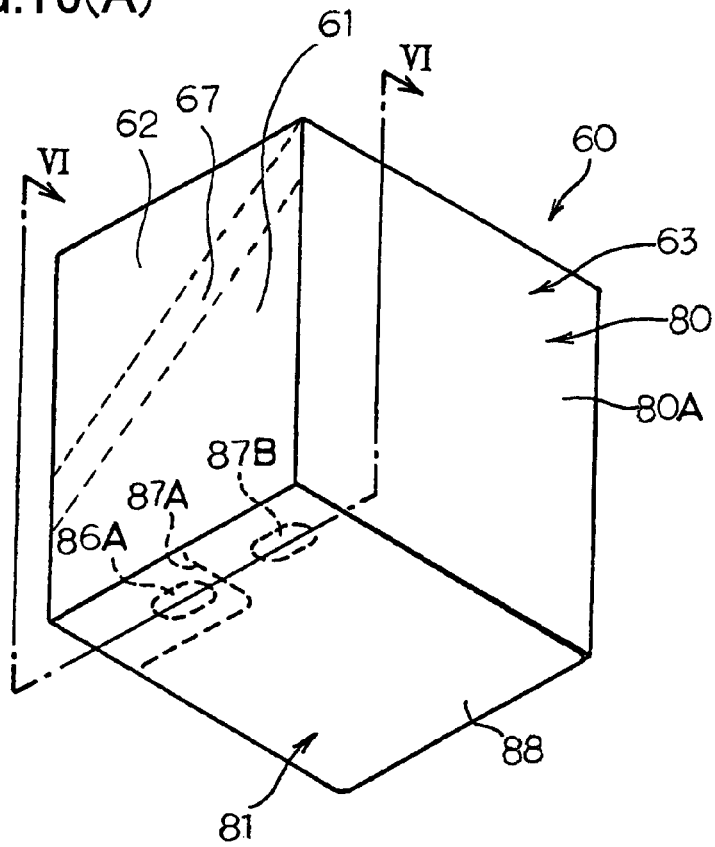
FIG. 16(A) is a perspective view showing the bottom surface of the paper container, wherein a bonding procedure is completed.
Figure 16B:
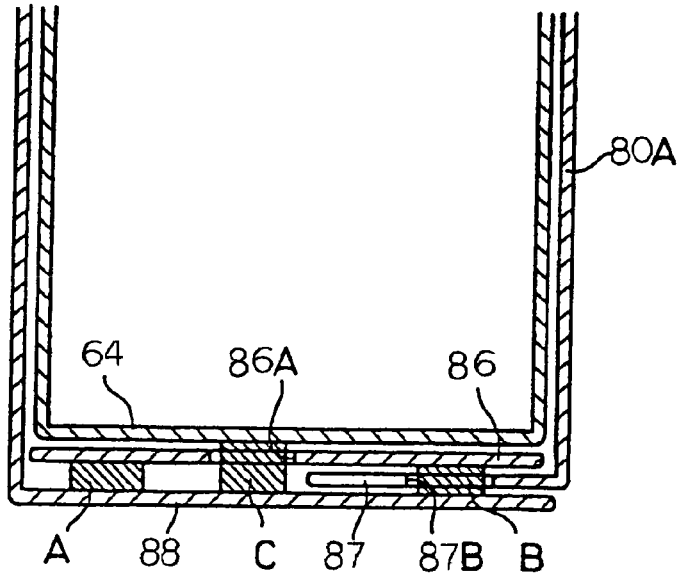
FIG. 16(B) is a sectional view taken on line IV—IV of FIG. 16(A).

(1) The intermediate flap 87 is folded on the outer surface of the inner flap 86, for example, three streaks of adhesive agents A, B, C are applied to those outer surfaces. The adhesive agent A is applied to the outer surface of the intermediate flap 87 and the outer surface of the inner flap 86 at the lower side of the cutout part 87A of the intermediate flap 87. The adhesive agent B is applied to the outer surface of the intermediate flap 87 and the outer surface of the inner flap 86 at the lower side of the cutout part 87B of the intermediate flap 87. The adhesive agent C is applied to the outer surface of the intermediate flap 87, the outer surface of the inner flap 86 at the lower side of the cutout part 87A of the intermediate flap 87, and the cutout part 86A of the inner flap 86 which corresponds to the cutout part 87A of the intermediate flap 87 (FIGS. 14 and 15).

(2) The outer flap 88 is folded on the inner flap 86 and the intermediate part 87 of the above-mentioned item (1). The outer flap 88 is bonded to the intermediate flap 87 through the adhesive agents A, B, C and to the inner flap 86 through the adhesive agents A, B, C supplied to the cutout parts 87A, 87B of the intermediate flap 87 (FIGS. 16(A) and 16(B)).

(3) The inner carton 64 is inserted into the outer box 63 and folded on the inner surface of the inner flap 86 in item (2) mentioned above. The inner carton 64 is bonded to the outer flap 88 through the adhesive agent C supplied to the two cutout parts 86A, 87A of the inner flap 86 and the intermediate flap 87 (FIGS. 16(A) and 16(B)).

According to the fourth embodiment, the following function can be obtained.

(1) After the intermediate flap 87 is folded on the outer surface of the inner flap 86, adhesive agents A, B, C are applied to those outer surfaces and then, the outer flap 88 is folded thereon. By doing so, the outer flap 88 is bonded not only to the intermediate flap 87 through the adhesive agents A, B, C but also to the inner flap 86 through the adhesive agents A, B, C supplied to the cutout parts 87A, 87B of the intermediate flap 87. Accordingly, the inner flap 86, the intermediate flap 87 and the outer flap 88 can simultaneously be bonded together by a single adhesive agent applying process. Thus, the manufacturing process can be simplified and the facilities can be simplified, too.

(2) After the outer flap 88 is bonded to the intermediate flap 87 and the inner flap 86 by the above-mentioned item (1), the inner carton 64 is inserted into the outer box 63. By doing so, the inner carton 64 is bonded to the outer flap 88 through the adhesive agent C supplied to the two cutout parts 86A, 87A of the inner flap 86 and the intermediate flap 87. Accordingly, by a single adhesive agent applying process, not only the inner flap 86, the intermediate flap 87 and the outer flap 88 can simultaneously be bonded together but also the inner carton 64 can be bonded.

It should be noted that the present invention can be modified in various ways without being limited to the above embodiments. For example, the lock part for the lid member is not necessarily provided at a lower part of the concave cutout part, and the lock part may take any other suitable forms than a tongue. Moreover, the present invention is not limited to a container for storing a thin plate-like sheet-like detergent but it may also be applied to a container for storing powder-like detergent, an agglomerated detergent, a tablet type detergent and foodstuff, and the like. Furthermore, the side lid parts of the lid member are not necessarily in the form of a right angular triangle.

The paper container is not necessarily a rectangular parallelepiped box-like container, but it may take any other suitable configurations. The paper container of the present invention may store not only powder-like detergent but also foodstuff such as chocolate, donut and fried chicken, and any other contents containing oil. Moreover, the paper composing the paper container of the present invention is not necessarily a cardboard.

The composite raw materials for the container main body, the lid member and the faucet part, the plastic film may be sandwiched between the cardboard sheets or it may be bonded to the inner surface or outer surface of the cardboard. The faucet part and the bottom board are not necessarily limited to paper but they may be plastics or the like. In addition, it is also accepted that the container main body is not allow the insertion of the faucet part and that the container main body is provided at its front board with a concave cutout part.

What is claimed is:

1. A paper container having a hexahedral configuration which is formed by shaping paper into a box, said paper container comprising:

a container main body and a lid member hingedly attached to a back side edge part of an upper end open surface of said container main body for selectively closing the upper end open surface, an inner carton part being mounted on and separate from an inner side of said container main body and a concave cutout part being formed as a complete opening in a front board of said inner carton part said cutout part being large enough to allow removal of contents of said box from a front side, and said lid member comprising an upper surface lid part for covering said upper end open surface, a front surface lid part large enough to cover said concave cutout part, and a pair of side lid parts interposed between side edge parts of said upper surface lid part and side edge parts of said front surface lid part and adapted to vertically join said front surface lid part with said upper surface lid part, said container main body and lid member being formed by cutting and dividing said hexahedral paper box through a severance guide line extending from opposite ends of a connecting ridge line between an upper board and a back board of said paper box, and said severance guide line extending obliquely downward from the opposite ends of said connecting ridge line along a pair of side boards and extending along said front board beneath said concave cutout part formed in the front board of said inner carton so that an upper half of said front board of said inner carton part is above said severance guide line; and said cutout part and said lid member being of a size to allow contents of said container to be removed when the upper surface lid part of said lid member extends only as far backward as said back board, wherein said paper container is for storing a sheet-like detergent, a tablet-type detergent or an agglomerated detergent.

2. A paper container according to claim 1, wherein a lock part is disposed beneath said concave cutout part and adapted to lock a lower end part of said front surface lid part of said lid member.

3. A paper container according to claim 1, which stores an oil containing-content, in which said paper is formed of a paper base material, a printed layer covering an outer surface of said paper base material, an outer colored film covering an outer surface of said printed layer, and an inner film covering an inner surface of said paper base material.

4. A paper container according to claim 1, for storing a packaged detergent.

5. A paper container according to claim 1, for storing a sheet-like detergent which is packaged with a water-soluble sheet and stacked up in layers, and wherein an inner surface of said lid member in a closed position overlies said inner carton part, and said container main body, said inner carton part and lid member are formed of a moisture-proof material.

6. A paper container according to claim 1, in which an inner flap, an intermediate flap and an outer flap extending from each side surrounding a bottom surface of said container main body or an upper surface of said lid member are overlapped with one another in this order and bonded together, wherein said intermediate flap is provided at a part thereof with a cutout part.

7. A paper container according to claim 1, wherein said front board of said inner carton part is made of a single piece.

8. A paper container according to claim 1, wherein said sheet-like detergent or tablet-type detergent are contained in a multi-layered manner.

9. A paper containing according to claim 1, wherein said inner carton part has a bottom board.

* * * * *